United States Patent [19]

Skatsche et al.

[11] 4,343,271

[45] Aug. 10, 1982

[54] LOW-NOISE-LEVEL INTERNAL COMBUSTION ENGINES

[75] Inventors: Othmar Skatsche; Gerhard Feichtinger, both of Graz, Austria

[73] Assignee: Hans List, Graz, Austria

[21] Appl. No.: 112,429

[22] Filed: Jan. 16, 1980

[30] Foreign Application Priority Data

Feb. 7, 1979 [AT] Austria ..... 925/79

[51] Int. Cl.[3] ..... F02B 77/00

[52] U.S. Cl. ..... 123/198 E; 123/195 R; 181/204

[58] Field of Search ..... 123/198 E, 195 C, 195 S, 123/195 R; 181/204

[56] References Cited

U.S. PATENT DOCUMENTS

| | | | |
|---|---|---|---|
| 3,464,398 | 9/1969 | Schetterlein et al. | 123/195 C |
| 4,071,008 | 1/1978 | Skatsche et al. | 123/198 E |
| 4,183,344 | 1/1980 | Kirchweger et al. | 123/198 E |
| 4,203,409 | 5/1980 | Fachbach et al. | 123/198 E |
| 4,213,439 | 9/1980 | Feichtinger et al. | 123/195 S |
| 4,213,440 | 7/1980 | Abe et al. | 123/195 C |
| 4,215,664 | 8/1980 | Hatz | 123/195 C |
| 4,257,369 | 3/1981 | Abe et al. | 123/198 E |

*Primary Examiner*—Wendell E. Burns

*Attorney, Agent, or Firm*—Watson, Cole, Grindle & Watson

[57] ABSTRACT

In an internal combustion engine with an engine unit support (1) comprising parts directly affected by body resonance as, e.g., cylinder block (2), cylinderhead (3), crankshaft (7) and crankshaft bearings (6), the engine unit support is connected to the crankcase (8) by means of several vibration absorbing and power transmitting elements (29) whereby the crankcase is insulated against body resonance. A sealing element (40; 44) is arranged between the engine unit support (1) for the crankcase (8) and sealing a lower oil-wetted part (15) of the engine oil-tightly against an upper dry part. The vibration absorbing elements (29) are mounted on the one side at the walls (25, 26) of the crankcase (8) and on the other side at the main bearing walls (20, 21) of the engine unit support in the region of the crankshaft axis (22).

Thereby, undesireable great deflections of the engine unit support in the region of the crankshaft axis can be avoided and the stressing of the elastic coupling between the flywheel and the gear unit or the elastic sealing elements, respectively, is considerably decreased.

8 Claims, 3 Drawing Figures

LOW-NOISE-LEVEL INTERNAL COMBUSTION ENGINES

BACKGROUND OF THE INVENTION

This invention relates to improvements in an internal combustion engine with an engine unit support comprising parts directly affected by body resonance as, e.g., cylinder block, cylinderhead, crankshaft, and crankshaft bearings. The engine unit support is connected to a crankcase by means of several vibration absorbing and power transmitting elements whereby the crankcase is insulated against body resonance, and a sealing element is arranged between the engine unit support for the crankcase and sealing a lower oil-wetted part of the engine oil-tightly against an upper dry part.

DESCRIPTION OF THE PRIOR ART

At a known engine of the aforementioned type, e.g., the one described in the U.S. Pat. No. 4,071,008, the vibration absorbing connection between the engine unit support and the crankcase is effected by a single circumferential vibration absorbing element which also simultaneously acts as a sealing element. The vibration absorbing element is fixed to a flange provided at the engine unit support in the region between the upper and the lower ends of the water jacket of the cylinder block and to a suitable counter-flange at the upper brim of the crankcase which is open at its upper side. Compared to the customary built up engines a marked reduction in noise emission could be obtained by this known arrangement. Because of the possible relative motion between the engine unit support and the crankcase enabled by the elastic vibration absorbing element the described arrangement needs an elastic coupling between the flywheel of the engine and the primary shaft of the gear unit flange connected to the crankcase. As the position of the elastic vibration absorbing element between the engine unit support and the crankcase is relatively high above the crankshaft axis, great lateral deflections of the lower part of the engine unit support and, therefore, the crankshaft can occur at certain operating conditions of the engine, whereby the elastic coupling between the flywheel and the primary shaft of the gear unit would be heavily stressed. Moreover, the elastic sealing elements at the opening for the crankshaft in the crankcase are heavily stressed, also, so that problems with the sealing element between the crankcase and the flywheel can result.

SUMMARY OF THE INVENTION

It is an object of the present invention to avoid the described disadvantages of the mentioned known engines without losses in the reduction of the sound emission. According to the present invention provision is made for the engines of the aforementioned type that the vibration absorbing elements are mounted on the one side at the walls of the crankcase and on the other side at the main bearing walls of the engine unit support in the region of the crankshaft axis. Thereby, undesireable great deflections of the engine unit support in the region of the crankshaft axis can be avoided and the stressing of the elastic coupling between the flywheel and the gear unit or the elastic sealing elements, respectively, is considerably decreased.

According to another embodiment of this invention it is possible that one of the vibration absorbing elements at a time is mounted at a front and a rear main bearing wall at both sides of the engine unit support; preferably, the vibration absorbing elements are screwed to a lug at the main bearing walls at approximately right angles. Thereby, the bracing of the engine unit support takes place in the region of the crankshaft passing through the crankcase, which is an especially critical region of the engine. The arrangement of the lugs enclosing approximately right angles with the cylinder axes enables an advantageous and simple machining of these parts.

According to a further embodiment of this invention the vibration absorbing elements mounted at the flywheel side of the crankcase permit less elastic motion than the others. As the choice of the hardness of the vibration absorbing elements is a compromise between achievable noise reduction and a deflection of the crankshaft axis as low as possible, a further improved noise reduction and a decreasing of the stress at the elastic coupling between the flywheel and the primary shaft of the gear unit and at the elastic sealing element at the side of the coupling can be obtained by this embodiment. As by the arrangement of relatively hard vibration absorbing elements at the side of the flywheel the deflection of the crankshaft can be kept very low, it is possible in many cases to use a customary sealing ring instead of a special elastic sealing element. On the other hand, the soft vibration absorbing elements at the opposite end of the crankshaft enable a considerable reduction of the noise emission.

According to a still further embodiment of this invention the vibration absorbing elements are preformed as cylindrical resilient cushionings fixed to the engine unit support via one intermediate piece at a time and supported and axially secured by their outer ring in suitable bores at the crankcase. Thereby, it is advantageously possible to use customary resilient cushionings which show, besides the advantage of low cost, a high accuracy of manufacture so that the positioning of the engine unit support in the crankcase can be carried out very precisely. Furthermore, as the bores in the crankcase and, thereby, the resilient cushionings are accessible and adjustable from the outside, the assembly of the engine and the replacement of defective resilient cushionings is significantly simplified. In order to prevent sound vibrations from reaching the outside via the fixing screws of the resilient cushionings, provision is made—according to another feature of this invention—for the bores to be closed at the outside of the crankcase by means of a cap, e.g., of thermoplastic material. Because of the engine torque and the bracing of the engine unit support near the crankshaft axis the upper part of the engine unit support is subject to greater lateral deflections at some working ranges of the engine. Therefore, according to a further feature of this invention, the engine additionally comprises at least one elastic support assembly in the region of the upper brim of the crankcase, which laterally braces the engine unit support. Preferably, this elastic support assembly is adjustable. Thereby, undesireable great deflections are effectively prevented.

DESCRIPTION OF THE DRAWINGS

This invention will be hereinafter more specifically described with reference to the accompanying drawings, wherein.

DESCRIPTION OF THE PREFERRED EMBODIMENT

Figure 1:
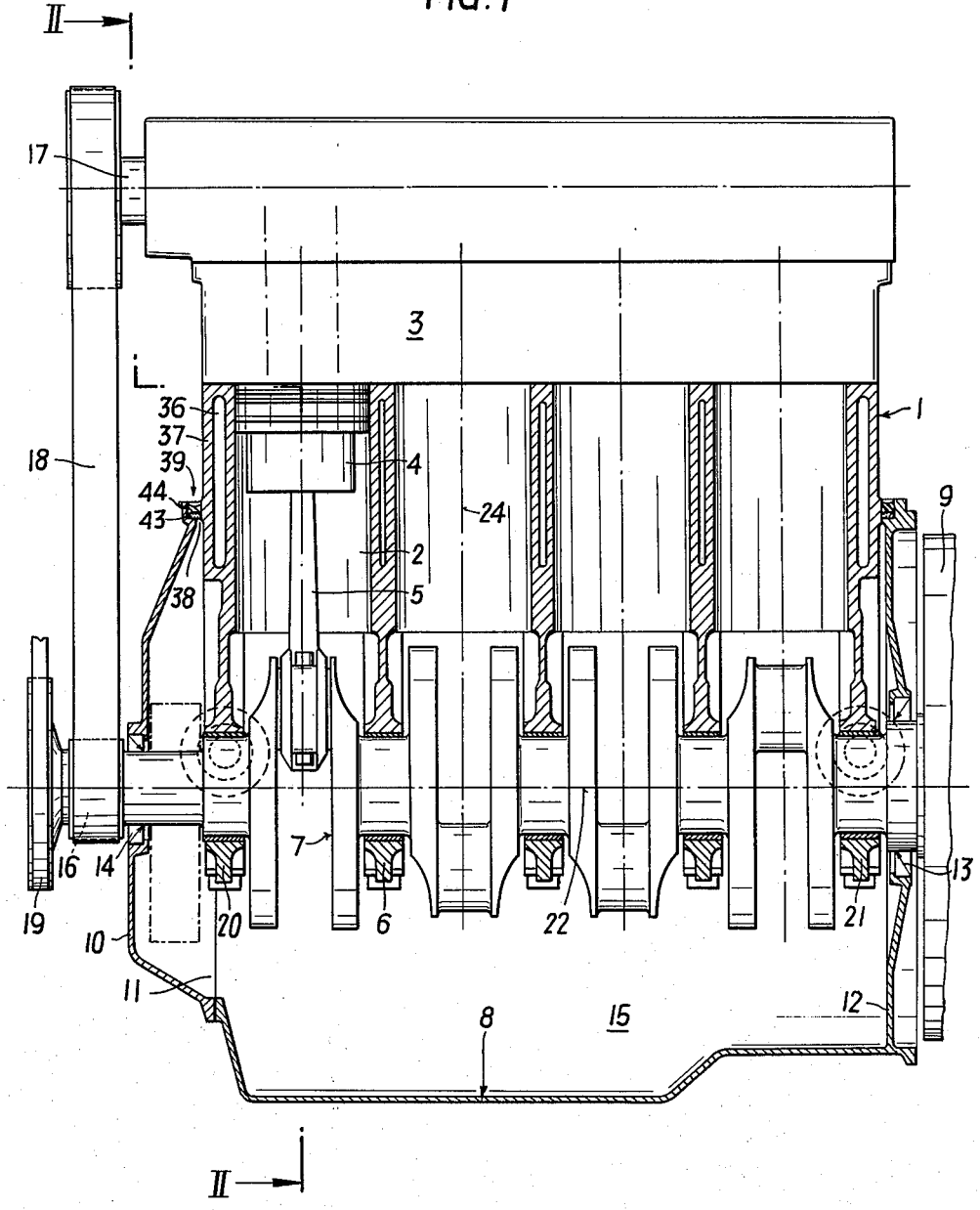
FIG. 1 is a longitudinal sectional view of an engine according to the invention.

An internal combustion engine according to this invention comprises an engine unit support 1 which encloses parts directly affected by body resonance, namely cylinder 2, cylinderhead 3, piston 4, connecting rods 5, crankshaft bearings 6, and crankshaft 7, and a crankcase 8 open at its upper brim, which includes a removable lid 10 at a side opposite a flywheel 9 at an end of the crankshaft 7. The crankcase 8 is preformed closely at its lower side; the assembly and disassembly of the engine unit support 1 occurs via the opening 11 at the front side of the crankcase 8, closed up by the lid 10. Both ends of the crankshaft 7 pass through the crankcase, whereby customary sealing rings 13 and 14 at the front side 12 near the flywheel as well as at the lid 10 are provided for the sealing of the crankcase space 15 against the outside. At the front end of the crankshaft outside the crankcase a toothed wheel 16 for driving an overhead camshaft 17 via a toothed belt 18 and a V-belt pulley 19 for driving auxiliaries, are arranged.

In the region of the crankshaft axis 22 the engine unit support includes at both sides lugs 23 at the main bearing walls 20, 21 associated with both outer crankshaft bearings, the lugs extending toward the side walls 25, 26 of the crankcase at right angles to the cylinder axis 24. As an extension of the lugs 23, lugs 27 are provided at the crankcase side walls 25, 26, which each include a bore 28 for the mounting of a cylindrical elastic vibration absorbing element 29. The vibration absorbing elements 29 are preformed as customary cylindrical resilient cushionings and are adjusted with their outer rings 29' into the bores 28 and axially fixed by a shoulder 30 at the inner end of the bores 28. The inner ring 31 of the vibration absorbing elements 29 is loaded on a cylindrical intermediate piece 32, and is fixed via a spacer 34 by a screw 33 to the lugs 23 of the main bearing walls 20, 21. Thereby, the engine unit support 1 is supported in the crankcase 8 by means of four vibration absorbing elements 29. As the vibration absorbing elements 29 are easily accessible from the outside via the bores 28, the positioning of the engine unit support 1 or the replacement of defective vibration absorbing elements, respectively, can be carried out simply from the outside. In order to prevent sound emission via the screws 33 the bores 28 are closed by means of caps 35, which, e.g., consist of thermoplastic material.

Figure 2:
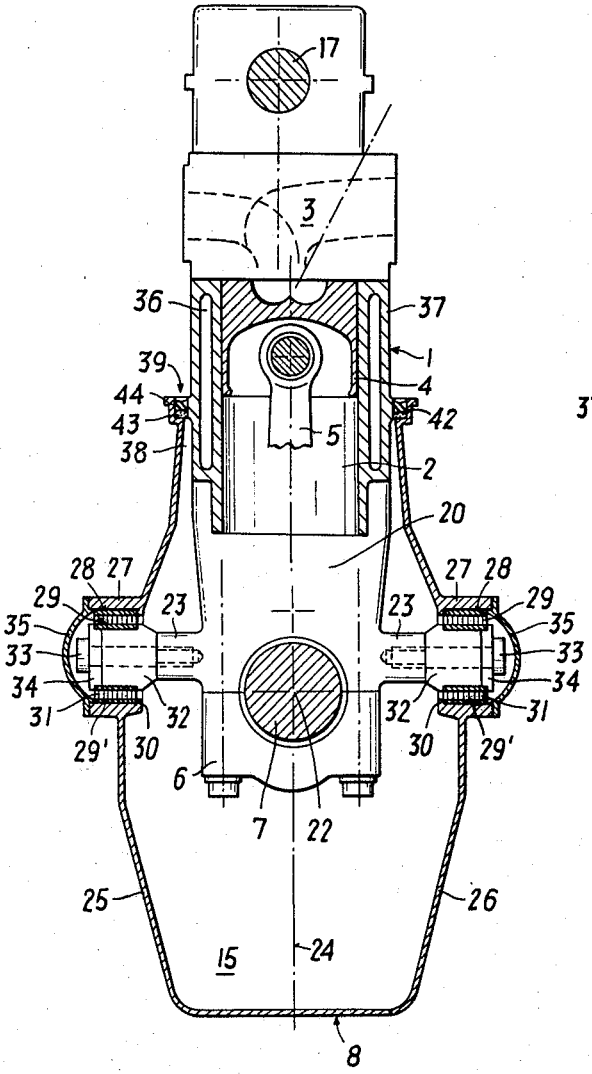
FIG. 2 is a cross sectional view along line II—II in FIG. 1.

The crankcase 8 extends upwardly to the region between the upper and the lower ends of the water jacket 36 and maintains there a circumferential space 38 with the outer cylinder wall 37, which enables the free and unavoidable lateral movement of the engine unit support to be elastically suspended in the crankcase without touching the encircling brim of the crankcase 8. A sealing element 39, 40 is arranged in the region of the upper brim of the crankcase 8 to seal the oil-wetted crankcase space 15 tightly against the outside. In the embodiment shown in FIGS. 1 and 2 the upper brim of the crankcase includes a clearance 42 into which an endorsing element 43 of foam rubber is inserted which bridges the space 38. The remainder of the groove formed by the clearance 42, the outer cylinder wall 37 and the endorsing element 43 is filled up with a resilient material 44, which enters an adhesive compound with metal, is resilient after curing and sticks tightly to the crankcase and the outer cylinder wall in the way of a vulcanization and thereby establishes the oil sealing.

Figure 3:
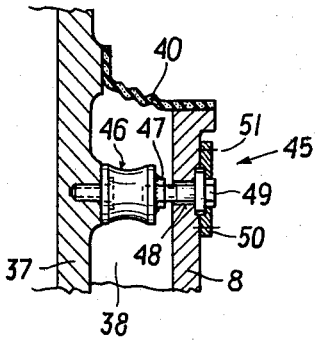
FIG. 3 shows the region of the upper brim of the crankcase with an elastic laterally bracing assembly.

If it is expected that the engine unit support will make undesireable great lateral movements in the region of the upper brim of the crankcase at certain working conditions of the engine because of the engine torque, these lateral movements can be limited by the arrangement of a lateral bracing assembly 45 as shown in the detail sketch of FIG. 3. Such a bracing assembly is preferably arranged in the region of the front and the rear end of the engine unit support at both sides of the latter. The embodiment according to FIG. 3 is only one of many possibilities and comprises a customary cylindrical elastic element 46 which is screwed at one side to a lug on the outer cylinder wall 37. At the other end the elastic element 46 shows a welded or soldered on unit 47, into which a collar screw 49 is threaded via an opening 48 of the crankcase 8. The collar screw 49 is supported on the one side by the crankcase 8 and on the other side by a carrier plate 50 which is fixed to the crankcase 8 by means of screws indicated by their axes of symmetry 51. After the adjustment of the lateral bracing assembly the carrier plate 50 simultaneously serves as protection against torsion. In the FIG. 3 embodiment, the space 38 between the upper brim of the crankcase 8 and the engine unit support is sealed by a circumferential sealing element 40 which is simply fixed to a fitting surface provided at the crankcase and the engine unit support. The sealing element 40 is resilient and does not have to transmit power.

What is claimed is:

1. An internal combustion engine comprising, an engine unit support containing parts directly affected by sound vibration, namely a cylinder head, cylinders, pistons, connecting rods, crankshaft main bearings and crankshaft, and a crankcase connected with said engine unit support by sound insulating means, the improvement wherein said sound insulating means serves as a power transmitting support of said engine unit support on said crankcase and is disposed in the immediate vicinity of the crankshaft axis between opposing sides of said engine unit support and lateral walls of said crankcase, and said means comprising cylindrical elastic vibration absorbing elements mounted within said lateral walls of said crankcase and being readily accessible from outside said crankcase.

2. An internal combustion engine according to claim 1, wherein said vibration absorbing elements are stacked upon one another at a front and a rear main bearing wall at said opposing sides of said engine unit support.

3. An internal combustion engine according to claim 2, wherein lugs extend outwardly of said main bearing walls at approximately right angles to the central axis thereof, and threaded fasteners being provided for mounting said elements on said lugs.

4. An internal combustion engine according to claim 2, wherein said vibration absorbing elements mounted at the flywheel-side of the crankcase are less elastic than the remaining elements so as to permit less elastic motion than the remaining elements.

5. An internal combustion engine according to claim 1, wherein said vibration absorbing elements comprise cylindrical resilient cushionings, intermediate pieces coaxially supporting said cushionings in a stacked relationship, outwardly extending bores in said crankcase, and outer rings in said bores surrounding said cushionings.

6. An internal combustion engine according to claim 5, wherein outer caps of thermoplastic material cover said bores.

7. An internal combustion engine according to claim 1, further comprising at least one elastic support assembly in the region of the upper brim of said crankcase laterally embracing said engine unit support.

8. An internal combustion engine according to claim 7, wherein said elastic support assembly is adjustable.

* * * * *